US005592050A

United States Patent [19]

Higashi et al.

[11] Patent Number: 5,592,050

[45] Date of Patent: Jan. 7, 1997

[54] METAL HALIDE LAMP

[75] Inventors: Tadatoshi Higashi, Tokyo; Tomoyoshi Arimoto, Tatsuno, both of Japan

[73] Assignee: Ushiodenki Kabushiki Kaisha, Japan

[21] Appl. No.: 425,102

[22] Filed: Apr. 20, 1995

[30] Foreign Application Priority Data

Apr. 20, 1994 [JP] Japan ..... 6-104490

[51] Int. Cl.[6] ..... H01J 17/20; H01J 61/12

[52] U.S. Cl. ..... 313/637; 313/576; 313/641

[58] Field of Search ..... 513/573, 576, 513/637–641

[56] References Cited

U.S. PATENT DOCUMENTS 4,992,700 2/1991 Lake ..... 313/638 X 5,479,065 12/1995 Sugimoto et al. ..... 313/638 X

*Primary Examiner*—Sandra L. O'Shea
*Assistant Examiner*—Mack Haynes
*Attorney, Agent, or Firm*—Sixbey, Friedman, Leedom & Ferguson, P.C.; David S. Safran

[57] ABSTRACT

A metal halide lamp in which rare earth halides are encapsulated and the occurrence of milky cloudiness is suppressed to achieve a prolongation of the service life of the lamp. To achieve this result, inert gas, mercury, indium halide, cesium halide, and rare earth halides are encapsulated in an emission part, with the encapsulation amount of the indium halide being from 0.8 micromole to 8.0 micromole/cm$^3$ of tube volume, and the lamp is operated with an essentially horizontal arc axis using a direct current. Furthermore, iodine and bromine are contained in the halogen which forms the halides, and there is a ratio of the iodine atom number to the total halogen atom number is greater than or equal to 50%.

1 Claim, 1 Drawing Sheet

METAL HALIDE LAMP

BACKGROUND OF THE INVENTION

1. Field of the Invention

The invention relates to a metal halide lamp, especially a metal halide lamp of the short arc type which is used as a light source of a television set of the liquid crystal projection type.

2. Background of the Invention

For a fight source of a television set of the liquid crystal projection type, a metal halide lamp with high efficiency and good color rendering has been recently used. For a lamp of this type, a lamp is often used in which halides of rare earth metals, such as dysprosium, neodymium and the like, as well as a halide of cesium, are encapsulated.

Encapsulation amounts of these materials are often greater than or equal to 0.4 micromole/$cm^3$ fluorescent tube volume for the rare earth metal halides and greater than or equal to 0.2 micromole/$cm^3$ fluorescent tube volume for the cesium halide.

Due to the requirement of high brightness, this lamp is operated with a high lead of 35 W/$cm^2$ to 80 W/$cm^2$. The temperature of one fluorescent tube wall is therefore greater than or equal to 900° C. In luminous operation of the lamp with a duration of several hundred hours, therefore, milky cloudiness occurs on the tube wall.

Since the occurrence of milky cloudiness greatly degrades the light efficiency, it can be stated that, essentially, the occurrence of the milky cloudiness marks the end of the service fife of the lamp.

As a process for preventing the occurrence of milky cloudiness, conventionally, a cesium halide was added; however, the action was not satisfactory enough. For example, in luminous operation of a conventional lamp for 2000 hours, the screen fight flux drops to less than or equal to 50% of the screen light flux at the start of luminous operation; this undoubtedly occurs as the result of the influence of the milky cloudiness.

On the other hand, as a process for operating the above described metal halide lamp, ordinarily alternating current luminous operation using the line frequency (50 Hz–60 Hz) and luminous operation using acutely angular waves with roughly 50 Hz to 500 Hz are used in practice. Furthermore, luminous operation using a direct current is proposed.

In luminous operation using direct current, it is necessary to induce convection in a suitable amount within the lamp in order that polarization of the emission material present inside the lamp is prevented in a certain area, which can also be designated concentration or accumulation on a certain side. Convection is generally caused by heat originating from an anode, the lamp being arranged such that the arc axis is perpendicular to an upper electrode and a lower electrode.

On the other hand, by analyzing the milky deposit adhering to the fluorescent tube, it was found that it had formed by accumulation of microcrystalline silica (crystals which are called crystobalite) with a diameter of roughly 1 micron. The reason for the formation of this microcrystalline silica is presumably the following:

The rare earth metals which are encapsulated in the fluorescent tube are usually in a state in which they are bound to a halogen in the vicinity of the fluorescent tube. However, these rare earth halides vaporize when the temperature of the tube wall rises to roughly 850° C. If these vaporized rare earth halides occur in an arc with a high temperature, they are converted by dissociation into rare earth atoms, and by ionization or excitation of these rare earth atoms emission is effected. When the rare earth atoms within the arc, as a result of convection or diffusion up to one part with a low temperature, reach the vicinity of the tube wall, they are converted by recombination with the halogen back into rare earth halides.

Only a small part of the rare earth ions or rare earth atoms however are not recombined with the halogen, but can adhere to the fluorescent tube wall in one state of the ions or atoms.

It is assumed that these rare earth ions influence the silica of the quartz glass with a very high probability, and that the rare earth atoms do so with a certain probability and thus convert the silica into silica crystals in a microcrystalline state.

The possibility that the rare earth ions or the rare earth atoms reach as far as the fluorescent tube wall presumably increases, the smaller the distance between the arc and the tube wall and the higher the temperature of the tube wall. This means that milky cloudiness occurs more frequently, the higher the tube wall load of the lamp; this corresponds to an empirical fact.

SUMMARY OF THE INVENTION

The object of the present invention is to suppress the occurrence of milky cloudiness in a metal halide lamp in which rare earth halides and cesium halide are encapsulated, and thus to increase the service life of the lamp.

This object is achieved according to the invention by the fact that within a metal halide lamp an inert gas, mercury, indium halide, cesium halide and rare earth halides are encapsulated, that the amount of indium halide encapsulated is 0.8 micromole to 8.0 micromoles/$cm^3$ fluorescent tube volume, and that the lamp is operated with an essentially horizontal arc axis using direct current.

The object is furthermore achieved by the fact that the halogen which forms the halide contains iodine and bromine, and that the ratio of iodine atom number to bromide atom numbers is greater than or equal to 50%.

According to the invention the following advantages are obtained:

First, the inventors have invented a process for suppression of the occurrence of milky cloudiness in which luminous operation with an arc axis held essentially horizontal is effected using a direct current. In this case, the polarization of the emission material ordinarily regarded as negative is used positively for suppression of milky cloudiness. This means that by luminous operation using direct current the rare earth ions are drawn toward the cathode, and in this way, polarization of the density of the rare earth atoms takes place from the cathode in the direction to the anode. In particular, by uninterrupted attraction of the rare earth ions by the cathode, the number of rare earth ions or rare earth atoms which reach as far as the tube wall can be reduced; this is a revolutionary reduction in the occurrence of milky cloudiness. In this respect, during luminous operation with a vertical arc axis, polarization of the emission material, that is, the rare earth atoms and the like, is prevented since convection due to heat takes place along the above described arc axis.

Second, according to the invention, a process is devised in which color shadowing which occurs as the result of polarization of the emission material is suppressed.

This means, according to the invention, it has been possible to largely suppress the color shadowing which takes place as the result of polarization of the emission material by a combination of polarization of the rare earth atoms which occurs due to the horizontal luminous operation with a certain material in which the polarization does not easily occur as the result of high vapor pressure. In addition, it was found that indium halide is optimum for this certain material.

Third, it has been possible according to the invention, by limiting the types of halogens within the halides to be encapsulated, to prevent corrosion of the electrodes, which often occurs as a problem when halides with a high vapor pressure are used, and at the same time, it has become possible to prevent blackening. Specifically, the halogen contains iodine and bromine, the ratio of the number of iodine atoms to bromine atoms being greater than or equal to 50%.

DETAILED DESCRIPTION OF THE PREFERRED EMBODIMENT

Figure 1:
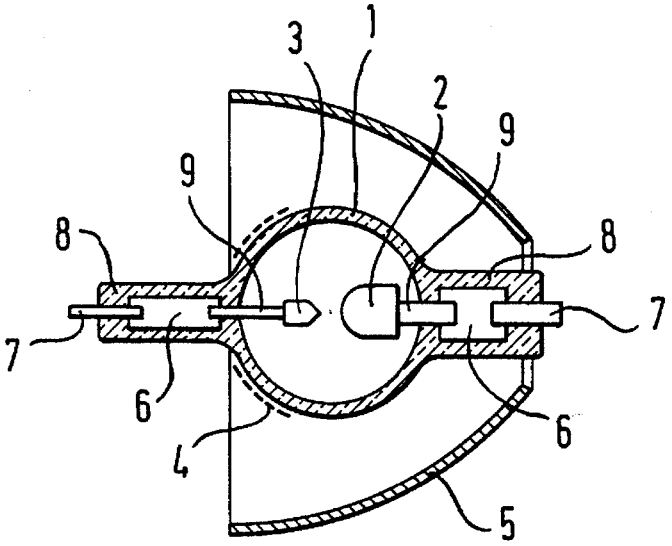
FIG. 1 is a cross-sectional view of a lamp according to a preferred embodiment of the invention.

FIG. 1 schematically shows an embodiment of a lamp according to the invention. In the representation, the lamp consists of essentially spherical emission part 1 from which two essentially cylindrical seal portions 8 project in opposite directions. Emission part 1 is formed of quartz, and has, for example, an inside diameter of 8.5 mm and an internal volume of 0.38 $cm^3$. Within emission part 1 are an anode 2 and a cathode 3 which are formed of tungsten and are arranged such that their tips lie opposite one another, spaced roughly 4.0 mm apart. Encapsulated in this emission part 1 are, for example, 0.4 mg indium iodide, 0.25 cm dysprosium iodide, 0.2 mg neodymium iodide, 0.2 mg cesium iodide, 16 mg of mercury, and 13 kPa argon gas as the starting gas.

In this embodiment, dysprosium and neodymium are used as rare earth metals. However, with respect to emission wavelengths other rare earth metals can likewise be used. For example, when red light is needed, dysprosium and lanthanum are used, when white light is needed, neodymium, thulium, holmium and erbium are used, and when blue light is needed lutetium, gadolinium and praseodymium and the like are used.

A heat insulation film of aluminum oxide 4 (represented as dashed lines) is applied to a cathode-side outer surface of the lamp. In the vicinity of the lamp is a reflector 5. In each cylindrical seal portion 8, a metal foil 6 and a lead 7 are connected to a respective one of the two electrodes 2, 3. A power supply line from a direct current source is connected to each of the leads 7.

In this case, during luminous operation of the lamp with an input power of 150 watts, both good light color and also an advantageous light yield were obtained. Specifically, in a lamp element, the color temperature is 7000° K. to 8000° K., there is a deviation from black radiation in the area of 0.01 in a UV color diagram, and the light yield is 68 to 73 lumen/W. These numerical values can be regarded generally as advantageous.

Figure 2:
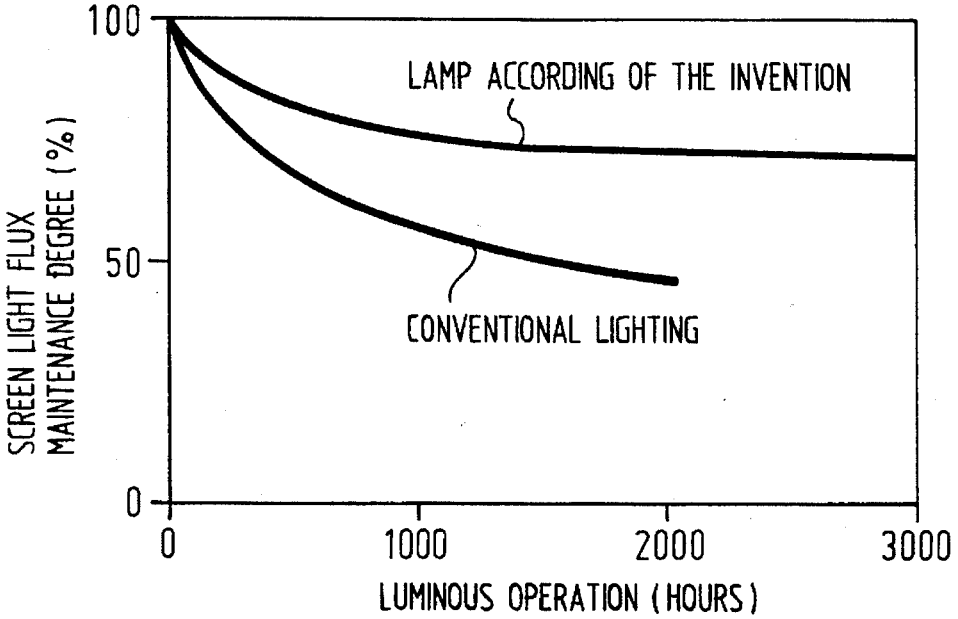
FIG. 2 graphically depicts the action of the lamp of the invention in comparison to that of a conventional lamp.

The lamp was arranged coaxially in reflector 5 such that the side of the cathode 3 is pointed to the outside, that is, the arc axis is horizontal. In this case, five of the same lamps were operated with an input power of 150 watts, from which it was ascertained that all lamps, even 2000 hours after start-up of luminous operation, maintained 70 to 75 % of the initial screen light flux. The term "screen light flux" is defined here as an amount of light on a screen which is measured by experimental production of a television set of the liquid crystal projection type. FIG. 2 shows the data hereof. This data shows that simply by means of horizontal luminous operation of the described lamp, the above-described phenomenon of the occurrence of milky cloudiness as the result of adhesion of rare earth ions or rare earth atoms on the fluorescent tube was suppressed.

Next, in the lamp shown in FIG. 1, the amount of indium halide encapsulated therein was changed. From this, it became apparent that at an encapsulation quantity of indium halide of less than 0.8 micromole/$cm^3$of emission part internal volume, the emission part is preferably polarized overall on the cathode side and that the lamp emission is not uniform, but is present, preferably, on one side.

On the other hand, there is a deviation of the luminous color of greater than or equal to 0.02 UV when the encapsulation quantity of indium halide is greater than 8.0 micromoles/$cm^3$ of the emission part internal volume. In this case, the color green becomes overall too strong; this means that color shadowing has occurred.

It is, therefore, advantageous to cause the encapsulation quantity of indium halide to be greater than or equal to 0.5 micromole/$cm^3$ emission part internal volume and less than or equal to 8.0 micromoles/$cm^3$ emission part internal volume. It is has been found to be especially desirable to utilize an encapsulation quantity of indium halide that is both greater than or equal to 2.0 micromoles/$cm^3$ emission part internal volume and less than or equal to 8.0 micromoles/$cm^3$ emission part internal volume, by which an even more advantageous action can be obtained.

This means that by horizontal luminous operation of the lamp shown in FIG. 1, the object of suppressing milky cloudiness can be achieved, and at the same time, by an optimum encapsulation quantity of indium halide good luminous operation can be achieved, in which neither non-uniform emission (preferentially toward one side) nor color shadowing occurs.

Next, with-a lamp with the same configuration as in the lamp illustrated in FIG. 1, by changes of the dimensions of the emission part and by changes of the materials to be encapsulated, an attempt was made to act on suppression of the milky cloudiness. This means that, here, a lamp was used into which additional bromides are encapsulated, while iodides are incorporated into the lamp shown in FIG. 1.

In this case, emission part 1 has an internal diameter of 9.5 mm and an internal volume of 1.0 $cm^3$. Within emission part 1, an anode and a cathode are located opposite one another, spaced a distance of 5.0 mm apart. At normal room temperature, 0.4 mg of indium iodide, 0.3 mg of indium bromide, 0.5 mg of dysprosium iodide, 0.4 mg of neodymium bromide, 0.4 mg of cesium iodide, 24 mg of mercury and 13 kPa argon gas are encapsulated.

In luminous operation of this lamp with an input power of 250 W, both good luminous color and also an advantageous light yield were obtained. Specifically, in a lamp element the color temperature is 7000° K. to 8000° K. and the light yield is 68 to 73 lumen/W. These numerical values can be regarded generally as advantageous.

In addition, the screen light flux was likewise measured. Here, it was found that even 2000 hours following start-up of luminous operation, a screen fight flux of 65 to 75% of the initial screen light flux was maintained.

Next, in the halides of this lamp, the ratio between the iodides and bromides was changed. Specifically, the encapsulation amounts of 4 mg iodides, indium iodide, dysprosium iodide, and cesium iodide, as well as of bromides, neodymium bromide and indium bromide, were changed. From this, it became obvious that the electrodes have the tendency to break prematurely as a result of extensive corrosion of root parts if the ratio of the bromides to the total amount of encapsulated halides is greater than or equal to 50%.

With respect to emission wavelengths, different types of rare earth elements can be used, for example, holmium, erbium, lutetium, praseodymium, lanthanum, and the like. In addition, these rare earth elements can likewise be used in combination with dysprosium.

Action of the Invention

As described above, according to the invention the occurrence of milky cloudiness which is a major disadvantage in a light source of a television set of the liquid crystal projection type using rare earth halides as emission materials can be suppressed in a revolutionary manner by a horizontal luminous operation position, direct current operation and by additional encapsulation of certain emission materials.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. Metal halide lamp of the short arc type having an emission tube with a high load output on a tube wall thereof of more than 35 W/cm$^2$, wherein an inert starting gas, mercury, rare earth halides, cesium halide, and from 0.8 micromole/cm$^3$ of tube internal volume to 8.0 micromoles/cm$^3$ of tube internal volume of indium halide are encapsulated within the emission tube; wherein an arc axis between electrodes of the emission tube is essentially horizontal; wherein said electrodes are connected to a source of direct current; and wherein iodine and bromine are contained in the halogen of said halides, and wherein a ratio of iodine atoms to total halogen atoms is at least equal to 50%.

* * * * *